US007028845B2

(12) United States Patent
Senior

(10) Patent No.: US 7,028,845 B2
(45) Date of Patent: Apr. 18, 2006

(54) PH ADJUSTMENT IN THE FLOTATION OF SULPHIDE MINERALS

(75) Inventor: Geoffrey David Senior, Mount Claremont (AU)

(73) Assignee: WMC Resources Limited, Victoria (AU)

( * ) Notice: Subject to any disclaimer, the term of this patent is extended or adjusted under 35 U.S.C. 154(b) by 0 days.

(21) Appl. No.: 10/469,247

(22) PCT Filed: Feb. 28, 2002

(86) PCT No.: PCT/AU02/00216

§ 371 (c)(1),
(2), (4) Date: Dec. 30, 2003

(87) PCT Pub. No.: WO02/070138

PCT Pub. Date: Sep. 12, 2002

(65) Prior Publication Data

US 2004/0101458 A1 May 27, 2004

(30) Foreign Application Priority Data

Feb. 28, 2001 (AU) ..... PR3437

(51) Int. Cl.
*B03B 7/00* (2006.01)
*B03D 1/00* (2006.01)
*B03D 1/02* (2006.01)

(52) U.S. Cl. ..... 209/166; 209/167; 209/168; 209/3; 209/12.1

(58) Field of Classification Search ..... 209/3, 209/12.1, 164, 166, 167, 168
See application file for complete search history.

(56) References Cited

U.S. PATENT DOCUMENTS 835,120 A * 11/1906 Sulman ..... 209/166
955,012 A * 4/1910 Sulman ..... 209/166
962,678 A * 6/1910 Sulman ..... 209/166
1,236,934 A * 8/1917 Higgins ..... 209/167
1,425,186 A * 8/1922 Ridsdale ..... 209/166
1,722,598 A * 7/1929 Stevens ..... 209/167
3,386,572 A * 6/1968 Cadwell ..... 209/3
3,485,356 A * 12/1969 Burr ..... 209/3

(Continued)

FOREIGN PATENT DOCUMENTS

AU 401720 * 11/1933

(Continued)

OTHER PUBLICATIONS

Trahar W.J. "A Retional Interpretation of the Role of Particle Size in Flotation" International Journal of Mineral Processing, Elsevier Science Publishers, Amsterdam NL, vol. 8, No. 4, Oct. 1981, pp. 289-327, XP009030927, ISSN: 0301-75161.

*Primary Examiner*—Thomas M. Lithgow
(74) *Attorney, Agent, or Firm*—Miles & Stockbridge P.C.; Edward J. Kondracki

(57) ABSTRACT

The present invention relates generally to a process for flotation of sulphide minerals where a flotation pulp is separated into a coarse stream and a fine stream, preferably containing particles coarser than about 30 micron and particles finer than about 30 micron, respectively. Typically, alkali and depressant are added to the coarse flotation stream only and acid and activator are added to the fine flotation stream only. During flotation of the fine stream, acid and/or activator may be added at the conditioning, cleaning, recleaning, cleaner-scavenging or third cleaning stage. During flotation of the coarse stream, alkali and/or depressant may be added at the conditioning or cleaning stage.

21 Claims, 4 Drawing Sheets

U.S. PATENT DOCUMENTS 3,735,869 A * 5/1973 Carpenter et al. ..... 209/726
3,919,079 A * 11/1975 Weston ..... 209/166
4,222,529 A * 9/1980 Long ..... 241/77
4,227,996 A 10/1980 Levine et al.
4,372,843 A 2/1983 Lawver et al.
4,436,616 A 3/1984 Dufour et al.
4,441,993 A 4/1984 Howald
5,837,210 A 11/1998 Simmons et al.

FOREIGN PATENT DOCUMENTS

GB 401720 * 11/1933
WO 93/04783 * 3/1993
WO WO 00/7456 A 12/2000
WO WO 01/39888 A1 6/2001

* cited by examiner

Figure I
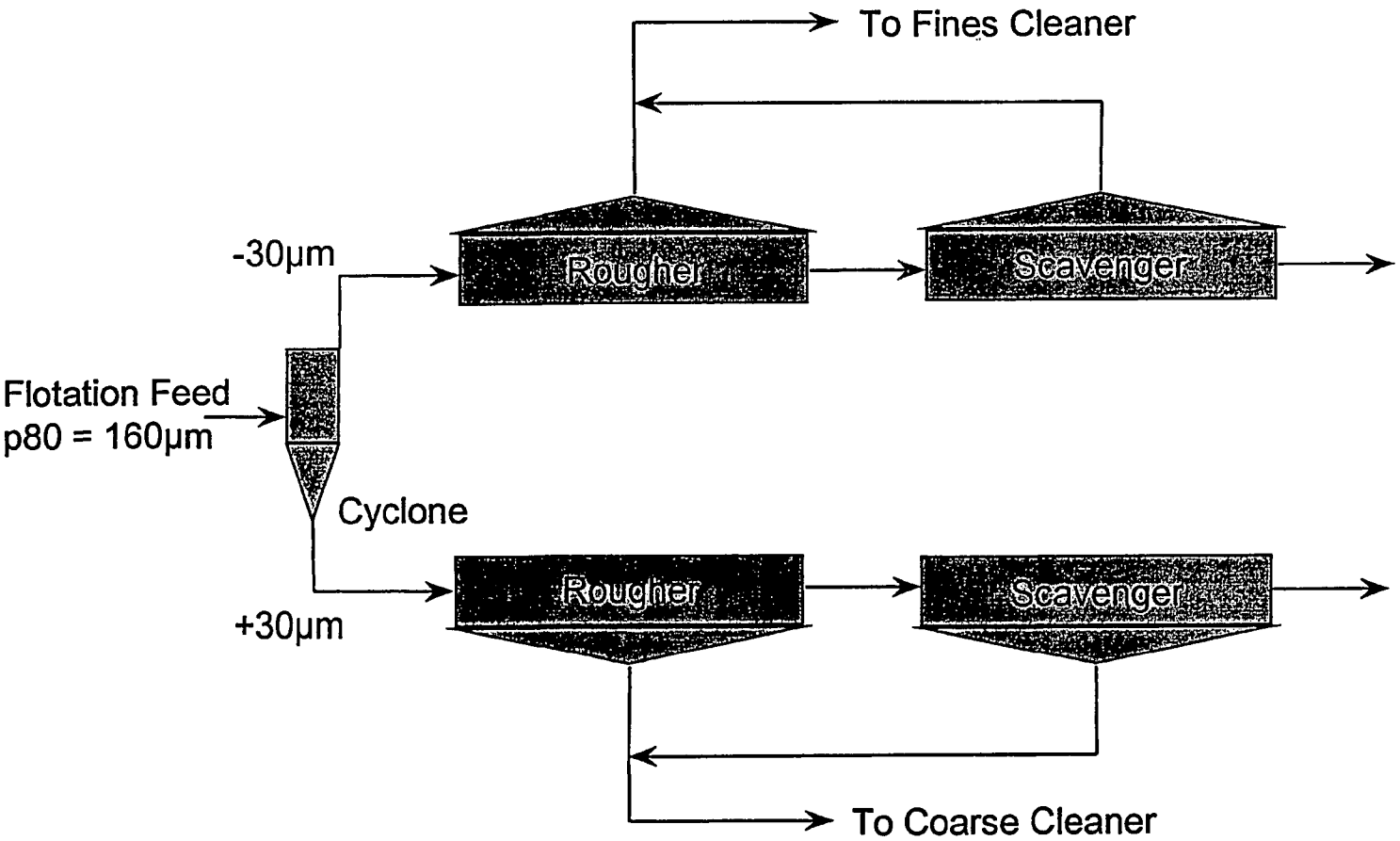

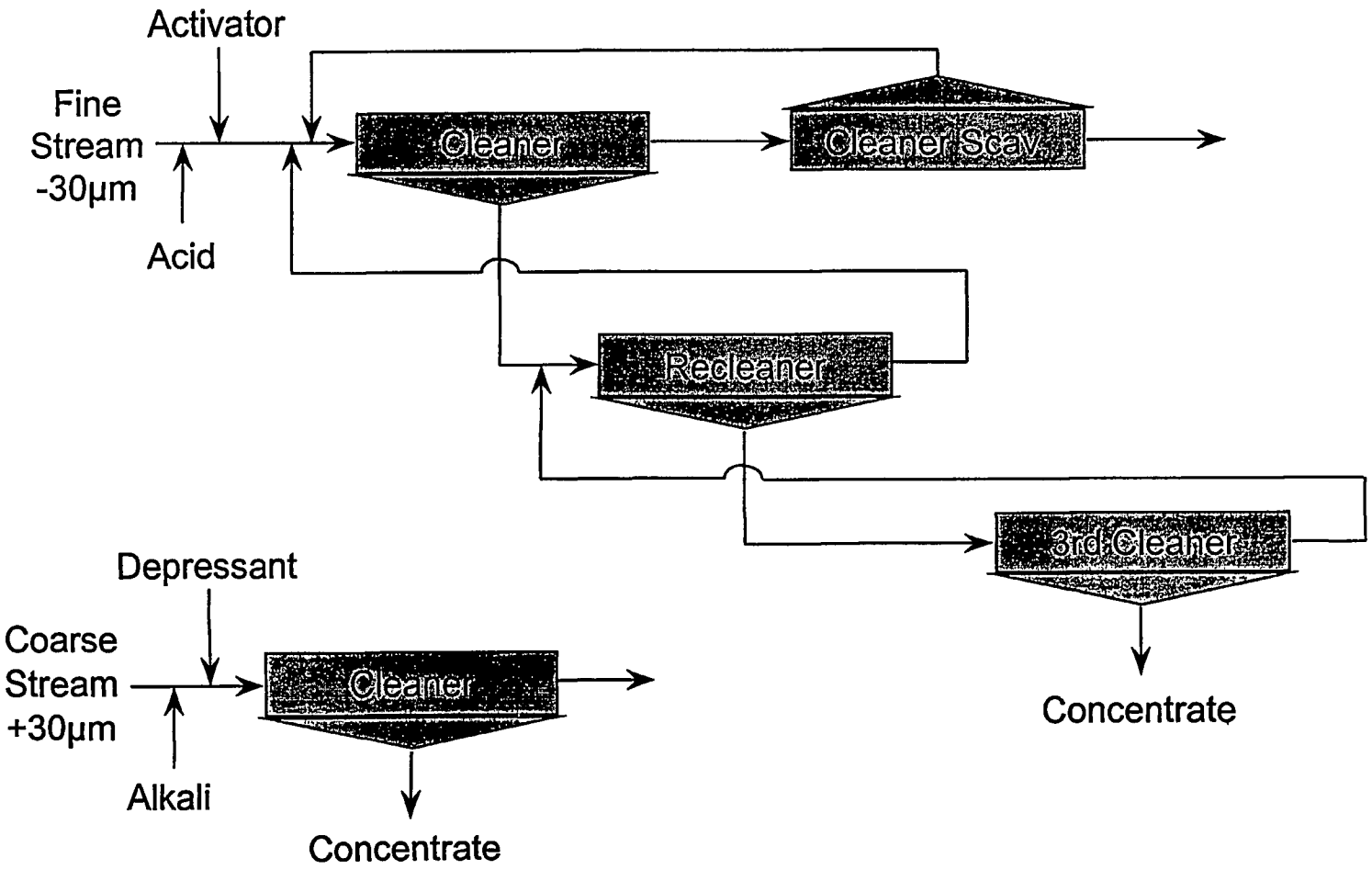
Figure II

Figure III
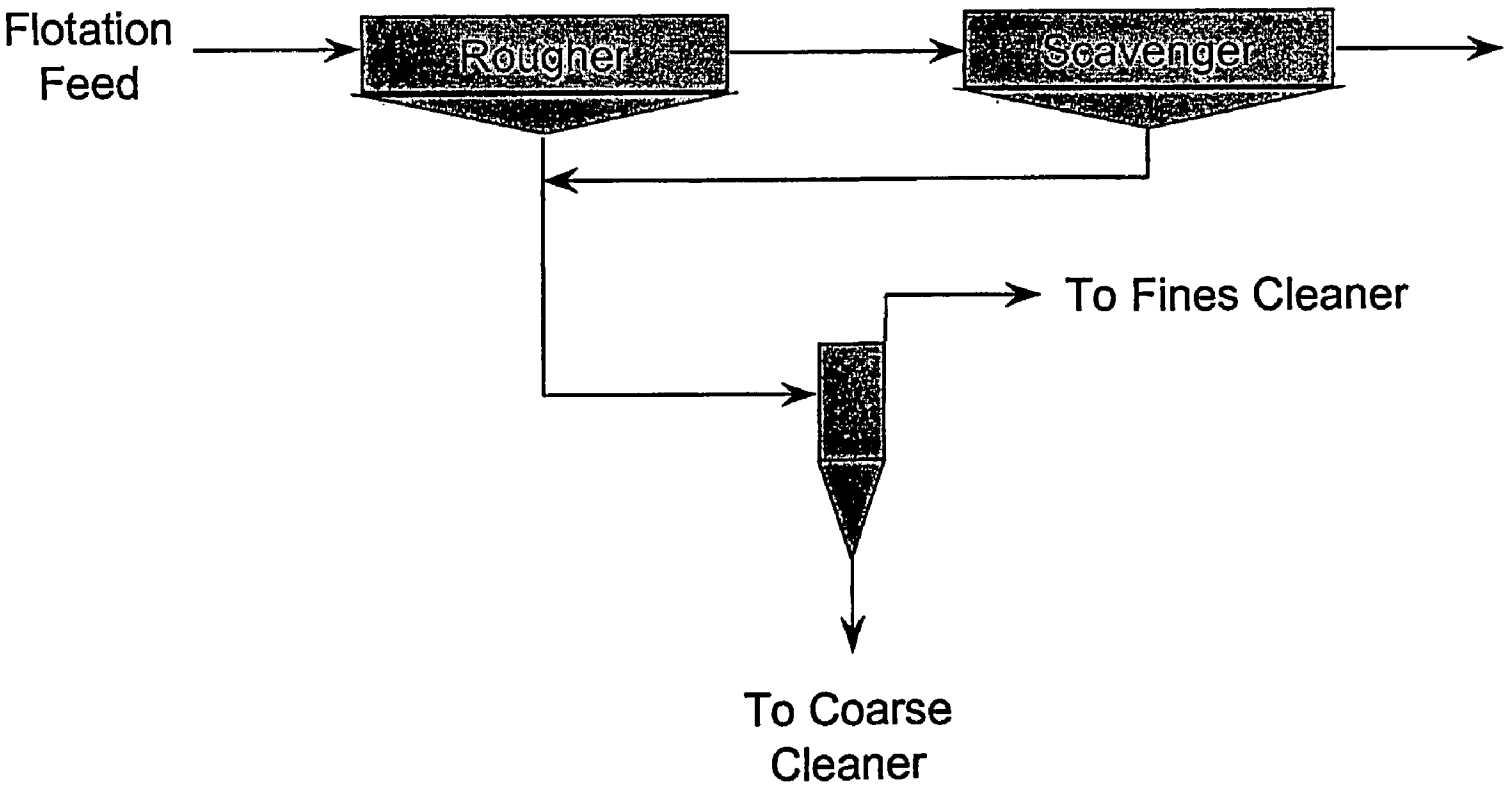

Figure IV
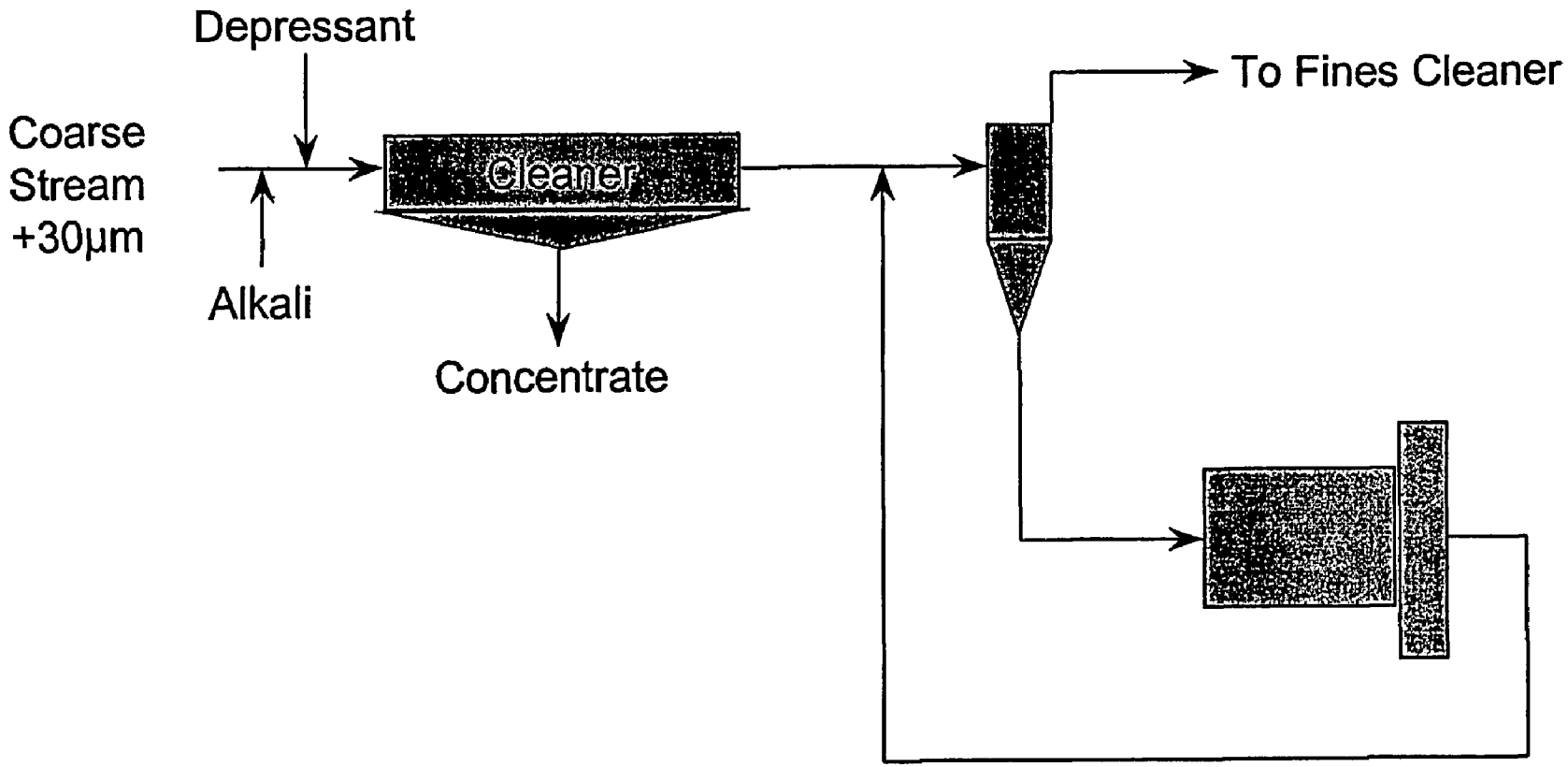

PH ADJUSTMENT IN THE FLOTATION OF SULPHIDE MINERALS

FIELD OF THE INVENTION

The present invention relates generally to a process and an apparatus for flotation of sulphide minerals particularly, but not exclusively, those that are hosted in ores rich in magnesium minerals.

BACKGROUND TO THE INVENTION

A conventional mineral process technique for separating sulphide minerals from ores rich in magnesium minerals involves the following steps:

(i) crushing and wet milling of the nickel sulphide ore to form a pulp having particles of a desired particle size distribution;

(ii) adding frother, collector and depressant to the pulp;

(iii) adding acid to the pulp;

(iv) adding an activator to the pulp;

(v) floating the valuable minerals in a rougher-scavenger stage with the primary object of maximising the recovery of the valuable sulphide minerals, and (vi) refloating the froth product from the rougher-scavenger stage in a cleaning stage with the object of producing a concentrate of the required quality by rejecting a maximum amount of gangue minerals and a minimum amount of valuable minerals.

The addition of collector makes the sulphide minerals hydrophobic and the addition of depressant minimises the recovery of gangue minerals to the flotation concentrate. The addition of acid and activator enhances the effect of the collector and, in turn, improves either recovery or grade or both. The flotation concentrate of valuable sulphide minerals is filtered and dried in preparation for smelting, or other secondary treatment processes such as leaching. For smelting or for other secondary processing, the amount of gangue, particularly magnesium bearing gangue, should be minimised.

It is recognised that small additions of reagents in the cleaning stage can improve the flotation of valuable sulphide minerals and can reduce the recovery of gangue. For the flotation of nickel ores rich in magnesium bearing minerals such reagents can include acid or base to lower or raise the pH, copper sulphate to activate the sulphides and polysaccharides to depress the flotation of the gangue minerals. It is also recognised that small additions of collector and frother throughout the circuit can be beneficial. Unfortunately, for many magnesium bearing ores, the addition of acid or base is poorly effective. For example, the addition of acid can promote the flotation of the valuable minerals but, in turn, cause low grade composite particles to float into the concentrate and lower the grade. Conversely, the addition of base can depress the flotation of the composite particles and, in turn, raise the concentrate grade, but the recovery is then reduced because the composite particles, and sometimes some liberated valuable particles, are lost from the froth phase. This problem can be particularly severe for nickel ores containing large amounts of magnesium bearing minerals.

A number of strategies have been employed in an attempt to overcome the competing effects of acids and alkalis and of activators and depressants in cleaner flotation circuits, these strategies including:

(i) making small staged additions of different reagents at various points in the circuits, and (ii) floating at a pH value that is intermediate between that for strong flotation of liberated particles and that for weak flotation of composite particles.

These strategies tend to be relatively ineffective and their applications are restricted and/or the benefits are limited, for example, in the cleaning circuit at the Mt Keith, Western Australia, concentrator of WMC Resources, only small additions of acid or activator can be made before large amounts of low grade composites are floated into the concentrate and the grade of the final product becomes unacceptably low. This is particularly a problem with low grade nickel sulphide ores, high in magnesium bearing minerals such as the ore treated at Mt Keith, Western Australia.

SUMMARY OF THE INVENTION

According to one aspect of the present invention there is provided a process for flotation of sulphide minerals, the process comprising the steps of:

separating a flotation pulp containing the sulphide minerals into a coarse stream and a fine stream; and adjusting the pH of the coarse and/or fine steam whereupon flotation of said stream(s) effects selective recovery of sulphide minerals.

Preferably the pH of the coarse stream is adjusted by the addition of alkali. Preferably the pH of the fine stream is adjusted by the addition of acid.

According to another aspect of the present invention there is provided a process for flotation of sulphide minerals, the process comprising the steps of:

separating a flotation pulp containing the sulphide minerals into a coarse stream and a fine stream;

treating the fine stream with acid and/or activator; and treating the coarse stream with alkali and/or depressant whereby the benefits of said treatments can be substantially realised during flotation without an unacceptable loss of grade and recovery.

The present invention was developed with a view to providing a process that allows fine and coarse particles to be cleaned at different pH values and with different activators and depressants. In particular, it allows fine particles to be floated at lower pH values than coarse particles. The invention preferably allows fine particles to be floated in the presence of activators and coarse particles to be floated in the presence of depressants. The benefit for ores high in magnesium bearing minerals is that both recovery and grade are maximised.

Preferably the fine stream and/or the coarse stream are treated in a cleaning circuit of the flotation process. More preferably the fine stream and the coarse stream are treated in the cleaning circuit with moderate amounts of acid/activator and alkali/depressant, respectively.

Preferably the separation of the pulp into the coarse and fine streams is performed at a so called cut size in the range 20 to 50 micron with the range 25 to 45 micron being particularly preferred. For example, the fine stream may contain particles predominantly finer than 30 micron and the coarse fraction may contain particles predominantly coarser than 30 micron. The amount of misreporting particles needs to be kept to a minimum in ways known to those skilled in the art. It is also to be understood by those skilled in the art that the optimum cut size for separation will be determined by the texture of the ore and, in particular, the size at which the valuable minerals become substantially liberated from gangue minerals. As far as practical, the fine fraction should contain mostly liberated particles and the coarse fraction should contain mostly composite particles Preferably the coarse and fine streams are separated using cyclones, but other devices such as screens can be used. Possibly, a plurality of cyclones arranged in series are provided for separating the pulp into the coarse and fine streams.

Preferably the coarse and fine streams are separated before a rougher-scavenger stage of the flotation process. Thus the benefits of separating the streams are also obtained in the rougher-scavenger stage according to the invention disclosed in the applicant's International patent application No. PCT/AU00/01479.

Preferably the fine stream is floated at a low solid/liquid ratio to avoid the tendency for pulps to become viscous and to lower the recovery of fine magnesium minerals into the froth by physical carry-over with the water, the so-called entrainment effect. It is known that the presence of some magnesium minerals causes pulps to become readily viscous which, in turn, reduces the dispersion of air in flotation cells.

Preferably the acid and/or activator is added to the fine stream during one or more of the following stages:

fine stream cleaner feed conditioning;

fine stream cleaner bank;

fine stream recleaner bank;

fine stream cleaner-scavenger bank; and/or fine stream third cleaner bank.

Preferably the fine stream is treated with an acid selected from the group consisting of sulphuric acid, hydrochloric acid, nitric acid, sulphurous acid, sulphamic acid, or some other suitable inorganic/organic acid.

Preferably the fine stream is treated with an activator selected from the group consisting of copper sulphate, lead nitrate, sodium sulphide, sodium hydrogen sulphide, sodium hydrosulphide or some other inorganic or organic reagent known by those skilled in the art to promote the flotation of sulphide minerals, particularly nickel sulphide minerals.

Importantly, by treating the fine stream only with acid and/or activator, the recovery of valuable minerals is improved markedly without the unacceptable loss of concentrate grade that occurs by treating the whole pulp.

Preferably the alkali and/or depressant is added to the coarse stream during one or more of the following stages:

coarse stream cleaner feed conditioning; and/or coarse stream cleaner bank.

Preferably the coarse stream is treated with an alkali selected from the group consisting of sodium hydroxide, sodium carbonate or ammonia, or some other suitable inorganic/organic base.

Preferably the coarse stream is treated with a depressant selected from the group consisting of guar or starch or some other inorganic or organic reagent known by those skilled in the art to depress the flotation of gangue minerals, particularly magnesium bearing gangue minerals.

Significantly by treating the coarse stream only with an alkali and/or depressant, the grade of the final concentrate is improved markedly without the unacceptable loss of recovery that occurs by treating the whole pulp.

According to a further aspect of the present invention there is provided an apparatus for flotation of sulphide minerals, the apparatus comprising:

means for separating a flotation pulp containing the sulphide minerals into a coarse stream and a fine stream;

means for treating the fine stream with acid and/or activator; and means for treating the coarse stream with alkali and/or depressant whereby the benefits of said treatments can be substantially realised during flotation without an unacceptable loss of grade and recovery.

Preferably the means for treating the fine stream comprises a fine stream conditioning tank, a fine stream cleaner bank, a fine stream cleaner-scavenger bank, a fine stream recleaner bank and/or fine stream third cleaner bank to which the acid and/or activator are added to one or more of the apparatus. More preferably the acid and/or the activator is added to a conditioning tank, a pipe/chute and/or a flotation cell.

Preferably the means for treating the coarse stream comprises a coarse stream conditioning tank and a coarse stream cleaner bank to which the alkali and/or depressant are added to one or more of the apparatus. More preferably the alkali and/or the depressant is added to a conditioning tank, a pipe/chute and/or a flotation cell.

Preferably the means for separating the pulp into a coarse stream and a fine stream comprises clusters of cyclones. Alternatively said separating means is a single cyclone.

BRIEF DESCRIPTION OF THE DRAWINGS

In order to facilitate a better understanding of the nature of the invention several embodiments of the process and apparatus for flotation of sulphide minerals will now be described in detail, by way of example only, with reference to the accompanying drawings, in which:

FIG. 1 illustrates schematically a classification and rougher-scavenger circuit capable of producing, in accordance with an embodiment of the present invention, a fine stream for cleaning in the presence of acid and/or activator and a coarse stream for cleaning in the presence of alkali and/or depressant;

FIG. 2 illustrates schematically a simplified cleaning circuit with, in accordance with an embodiment of the present invention, the fine stream for cleaning being conditioned with acid and/or activator and the coarse stream for cleaning being conditioned with alkali and/or depressant;

FIG. 3 illustrates schematically a classification and rougher-scavenger circuit capable of producing, in accordance with another embodiment of the present invention, a fine stream for cleaning in the presence of acid and/or activator and a coarse stream for cleaning in the presence of alkali and /or depressant, and FIG. 4 illustrates schematically a simplified cleaning circuit with, in accordance with another embodiment of the present invention, the fine stream for cleaning being conditioned with acid and/or activator and the coarse stream for cleaning being conditioned with alkali and/or depressant, and the tailings from the coarse cleaner being further classified so as to allow coarse low grade composites to be reground before being cleaned in the fines circuit.

DETAILED DESCRIPTION OF THE PREFERRED EMBODIMENTS

The present invention is according to one embodiment based on the discovery that an optimal combination of recovery and grade is achieved in cleaning when the feed is separated into a coarse stream containing particles coarser than about 30 micron and a fine stream containing particles finer than about 30 micron, and when alkali and depressant are added to the coarse stream only and acid and activator are added to the fine streams only. Separation of the feed or flotation pulp into coarse and fine streams is normally effected by cyclones, but may be effected by other means including, but not limited to, screen decks.

Coarse and fine particles are separated on the basis of size though it is recognised that cyclones to some extent also separate on the basis of density. Preferably the nominal size of separation needs to be between 20 and 50 micron with the range between 25 and 45 micron being particularly preferred. It is recognised that some particles will inevitably report to the incorrect stream in an industrial device like a cyclone, but that the amount of misreporting particles can be kept to a minimum in ways known to those skilled in the art. For example, the efficiency of size separation can usually be optimised by adding the correct amount of water to the feed slurry, by correct selection of cyclone dimensions and operating pressure and by appropriate selection of spigot and vortex finder sizes.

For the embodiment shown in FIG. 1, a nickel ore rich in magnesium minerals is crushed and ground such that 80% of the mass passes 160 micron. The ground product is then classified into fine and coarse streams using cyclones and the fine and coarse fractions floated in different rougher-scavenger circuits. The froth product from the rougher-scavenger circuit floating the fine particles then provides the feed to the fine cleaning circuit. The froth product from the rougher-scavenger circuit floating the coarse particles then provides the feed to the coarse cleaning circuit.

The fine and coarse rougher-scavenger concentrates are then preferably fed to separate cleaning circuits, as shown in FIG. 2.

During flotation of the fine stream, acid and/or activator may be added at the conditioning, cleaning, re-cleaning, cleaner-scavenging or third cleaning stage. The amount of acid or activator which must be added will depend on a range of factors including:

the type of ore;

conditioning time;

percents solids of the pulp;

the water quality; and pre-treatments/processing of the slurry.

For example, test work has been conducted using a fine stream from the Mt Keith concentrator in Western Australia. The stream was produced in a fine particle rougher-scavenger circuit, as illustrated in FIG. 1. For cleaner flotation, the stream was diluted to 10 percent solids and conditioned with acid for two minutes. Acid was added at a rate of between 70 and 310 gram/tonne (g/t), as calculated with respect to the whole ore. For each sample tested, a reference test was conducted without the addition of acid.

Table 1 compares results for cleaning of the fine stream, with and without acid. As can be seen from the table, the addition of acid raises recovery significantly, with little if any loss of concentrate grade. These data confirm the benefits of adding acid when cleaning fine particles.

TABLE 1

Improvements in recovery brought about by cleaning fine particles in the presence of acid.

| Test No. | | | Ni | Fe | MgO | Fe:MgO |
|---|---|---|---|---|---|---|
| 1. | A. Std Method | A | 18.0 | 19.2 | 14.8 | 1.3 |
| | | R | 82.0 | | | |
| | B. 310 g/t $H_2SO_4$ | A | 17.7 | 19.9 | 14.1 | 1.4 |
| | | R | 84.1 | | | |
| 2. | A. Std Method | A | 15.7 | 17.6 | 16.7 | 1.1 |
| | | R | 83.9 | | | |
| | B. 110 g/t $H_2SO_4$ | A | 15.6 | 17.7 | 16.7 | 1.1 |
| | | R | 87.5 | | | |
| 3. | A. Std Method | A | 16.4 | 17.4 | 16.7 | 1.0 |
| | | R | 69.3 | | | |
| | B. 100 g/t $H_2SO_4$ | A | 18.8 | 19.7 | 13.5 | 1.5 |
| | | R | 73.8 | | | |
| 4. | A. Std Method | A | 16.0 | 18.0 | 16.5 | 1.1 |
| | | R | 78.8 | | | |
| | B. 70 g/t $H_2SO_4$ | A | 17.5 | 19.4 | 14.3 | 1.4 |
| | | R | 84.4 | | | |

A = assay;
R = recovery

By contrast with the results in Table 1 the effect of adding acid to a stream containing a full size range of particles is to raise recovery, but to lower concentrate grade by an unacceptable amount. This difference can be seen by comparing the data in Table 1 with those in Table 2 which gives the outcomes of a statistical analysis of plant performance at Mt Keith, Western Australia, in which concentrates were cleaned in a conventional way in the presence and absence of acid. With a full size range of particles in the cleaner feed, the effect of the acid was to increase cleaner recovery by 2.5%, from 57.7% to 60.2%, but to lower grade by over 1.5%, from 20.5% Ni to 18.8% Ni (Table 2). This effect contrasts with that in Table 1 which shows that with just fine particles in the cleaner feed, the effect of acid is to raise recovery by between 2% and 5.5%, and, at worst, to lower grade by 0.3%. More often than not the grade is essentially unchanged or even improved.

TABLE 2

Detrimental effect of acid on concentrate grade when a full range of particle sizes is cleaned.

| | ACID ON | | | | | ACID OFF | | | | |
|---|---|---|---|---|---|---|---|---|---|---|
| | Ni | Concentrate Grade | | | | Ni | Concentrate Grade | | | |
| Quantity | Rec (%) | % Ni | % Fe | % MgO | Fe:MgO | Rec (%) | % Ni | % Fe | % MgO | Fe:MgO |
| Mean | 60.19 | 18.81 | 25.94 | 10.24 | 3.10 | 57.67 | 20.45 | 24.44 | 10.39 | 2.83 |
| Standard Deviation | 7.871 | 2.754 | 6.413 | 4.100 | 1.712 | 7.694 | 2.938 | 6.476 | 3.950 | 1.392 |
| Number of results | 36 | 36 | 36 | 36 | 36 | 27 | 27 | 27 | 27 | 27 |

The reason for the different effect of the acid in Tables 1 and 2 is that with a full size range of particles, the flotability of coarse low-grade composites is promoted as well as that of the fines. Mineralogical analyses confirmed that it was the presence of these composites in the concentrate that lowered the grade. Until the present invention, this situation presented a dichotomy in that acid was beneficial for flotation of fine particles, but was detrimental for coarse particles because it lowered concentrate grade.

Turning now to flotation of the coarse stream, according to an embodiment of the present invention, alkali and/or depressant may be added at the conditioning or cleaning stage. The amount of alkali and/or depressant which must be added will depend on a range of factors including:

the type of ore;

conditioning time;

percents solids of the pulp;

the water quality; and pre-treatments/processing of the slurry.

The effect of the alkali and/or the depressant is to lower the flotability of the coarse composites and, in turn, to raise the concentrate grade without an unacceptable loss of recovery.

This effect is shown in Table 3 for a series of tests using a coarse stream, also from the Mt Keith concentrator in Western Australia. The stream was produced in a coarse particle rougher-scavenger circuit, as illustrated in FIG. 1. For cleaner flotation, the stream was diluted to 10 percent solids and conditioned with alkali for two minutes. Alkali was added at a rate between 40 and 970 g/t, as calculated with respect to the whole ore. For each sample tested, a reference test was conducted without the addition of alkali.

In each of the tests, the effect of the alkali was to increase grade significantly without an unacceptable loss of recovery. As can be seen from the table, grade could typically be increased by between 2% and 4% Ni for a loss in cleaner recovery of less than 0.5 percent. The Fe:MgO of the concentrate also increased, a change which is of real importance for smelting.

By contrast with the effect on a coarse stream, alkali added to a fine stream causes a marked loss of both grade and recovery. This deterioration is shown in Table 4 for tests with samples from Mt Keith, Western Australia, collected in the same way as for the tests in Table 1. For the tests in Table 4 the addition of alkali, lowered grade by over 4% Ni and recovery by over 17 percent.

Until the current discovery, the differing effects of alkali and acid on coarse and fine particles in cleaning circuits was not known nor was it be predictable from conventional flotation theory or practice.

TABLE 3

Improvements in concentrate quality brought about by cleaning coarse particles in the presence of alkali.

| Test No. | | | Ni | MgO | Fe:MgO |
|---|---|---|---|---|---|
| 1. | A. Std Method | A | 19.0 | 7.7 | 4.1 |
| | | R | 98.1 | | |
| | B. 110 g/t NaOH | A | 19.9 | 7.1 | 4.5 |
| | | R | 98.1 | | |
| 2. | A. Std Method | A | 16.7 | 12.2 | 2.2 |
| | | R | 98.1 | | |
| | B. 110 g/t NaOH | A | 18.5 | 9.8 | 2.9 |
| | | R | 98.1 | | |
| | C. 425 g/t NaOH | A | 20.0 | 8.3 | 3.5 |
| | | R | 97.6 | | |

TABLE 3-continued

Improvements in concentrate quality brought about by cleaning coarse particles in the presence of alkali.

| Test No. | | | Ni | MgO | Fe:MgO |
|---|---|---|---|---|---|
| 3. | A. Std Method | A | 17.6 | 11.7 | 2.4 |
| | | R | 98.2 | | |
| | B. 85 g/t NaOH | A | 18.8 | 10.8 | 2.7 |
| | | R | 98.6 | | |
| | C. 310 g/t NaOH | A | 20.5 | 8.4 | 3.6 |
| | | R | 97.7 | | |
| 4. | A. Std Method | A | 18.7 | 9.9 | 2.9 |
| | | R | 99.0 | | |
| | B. 85 g/t NaOH | A | 19.1 | 9.1 | 3.2 |
| | | R | 98.6 | | |
| | C. 970 g/t NaOH | A | 22.6 | 5.2 | 6.1 |
| | | R | 98.6 | | |
| 5. | A. Std Method | A | 19.3 | 9.1 | 3.2 |
| | | R | 97.4 | | |
| | B. 480 g/t NaOH | A | 21.6 | 7.5 | 3.9 |
| | | R | 97.3 | | |
| 6. | A. Std Method | A | 16.5 | 7.2 | 4.8 |
| | | R | 93.6 | | |
| | B. 40 g/t NaOH | A | 16.7 | 7.5 | 4.6 |
| | | R | 95.3 | | |
| | C. 500 g/t NaOH | A | 18.1 | 6.4 | 5.5 |
| | | R | 95.3 | | |

A = assay;
R = recovery

Just as alkali can be added to a coarse stream to improve grade without an unacceptable loss of recovery, so too can polysaccharides such as guar gum which can be added as a talc depressant. This result is shown in Table 5 for coarse streams from Mt Keith, Western Australia, floated in the presence and absence of guar gum. The addition of the depressant typically raised grade by between 1% and 2% Ni for a loss of recovery of less than 2 percent.

TABLE 4

Deterioration in recovery and grade brought about by cleaning fine particles in the presence of alkali

| Test No. | | | Ni | Fe | MgO | Fe:MgO |
|---|---|---|---|---|---|---|
| 1. | A. Std Method | A | 18.3 | 23.2 | 12.2 | 1.9 |
| | | R | 71.2 | | | |
| 2. | B. 1400 g/t NaOH | A | 13.9 | 18.1 | 19.4 | 0.9 |
| | | R | 53.8 | | | |

A = assay;
R = recovery

TABLE 5

Improvements in concentrate quality brought about by cleaning coarse particles in the presence of talc depressant.

| Test No. | | | Ni | MgO | Fe:MgO |
|---|---|---|---|---|---|
| 1. | A. Std Method | A | 16.7 | 12.2 | 2.2 |
| | | R | 98.1 | | |
| | B. 10 g/t guar | A | 18.1 | 10.7 | 2.6 |
| | | R | 96.0 | | |
| 2. | A. Std Method | A | 17.6 | 11.7 | 2.4 |
| | | R | 98.2 | | |
| | B. 10 g/t guar | A | 19.4 | 9.7 | 3.0 |
| | | R | 97.5 | | |

TABLE 5-continued

Improvements in concentrate quality brought about by cleaning coarse particles in the presence of talc depressant.

| Test No. | | | Ni | MgO | Fe:MgO |
|---|---|---|---|---|---|
| 3. | A. Std Method | A | 18.7 | 9.9 | 2.9 |
| | | R | 99.0 | | |
| | B. 10 g/t guar | A | 19.6 | 8.7 | 3.4 |
| | | R | 97.4 | | |
| 4. | A. Std Method | A | 19.3 | 9.1 | 3.2 |
| | | R | 97.4 | | |
| | B. 10 g/t guar | A | 20.1 | 8.7 | 3.3 |
| | | R | 97.9 | | |

A = assay;
R = recovery

A further advantage of the current invention is that low grade coarse particles can be isolated for regrinding from the tailings of the cleaner circuit treating the coarse stream. Mineralogical analyses of the tailings from the tests in Table 3 and 5 confirmed that such particles were effectively rejected once alkali or guar are added. FIG. 4 shows schematically an embodiment of the invention by which the low grade particles could be isolated and reground before being cleaned. The basic flowsheet is similar to that in FIG. 2 for the coarse stream, except that a classification and regrind circuit is provided for isolating and regrinding the low grade coarse composites to improve the liberation of the nickel minerals. The reground cleaner tailing can then be combined with the fine stream feeding the fine particle cleaning circuit and floated as in FIG. 2. Other recycle streams are omitted for clarity.

An advantage of the described embodiments of the invention is that the tailings from the coarse and fine streams can be combined following cleaning, allowing the acid in the fine stream to be neutralised by the alkali in the coarse stream. In this way, the tailings products can be more readily disposed of, as they are neither strongly acidic nor strongly alkaline.

In assessing the various embodiments of the invention shown in FIGS. 1 to 4, it should be understood that streams within the cleaning circuits can be recycled in a variety of ways that are known to those skilled in the art. The tailings from the cleaning circuits themselves can also be recycled, for example, to points within rougher scavenger circuits. In other circumstances, these tailings might be discarded. Those skilled in the art will also recognise that the number of stages within a cleaner circuit can be varied depending on the final product quality required.

Now that several embodiments of the invention have been described in some detail it will be apparent to those skilled in the art that the process and apparatus for flotation of sulphide minerals have at least the following advantages:

1. significantly improved grades;
2. reduced losses of valuable minerals;
3. isolation of low grade, coarse composite particles that are suitable for regrinding; and
4. the opportunity to reduce/eliminate the environmental impacts of acid or alkali additions to cleaning circuits.

Numerous variations and modifications to the described process and apparatus will suggest themselves to persons skilled in the mineral processing arts, in addition to those already described. For example, the pH adjustment of the coarse and/or fine streams may occur at other stages of the respective flotation circuit, for example at the rougher and/or scavenger stages, although it is preferable that it be conducted at one or more of the cleaning stages. All such variations and modifications are to be considered within the scope of the present invention, the nature of which is to be determined from the foregoing description.

The invention claimed is:

1. A process for flotation of suiphide minerals, the process comprising the steps of:

separating a flotation pulp containing the suiphide minerals into a coarse stream and a fine stream at a cut size in the range of 20 to 50 microns;

treating the fine stream with acid and/or activator;

treating the coarse stream with alkali and/or depressant; and floating the fine and coarse streams in separate flotation stages;

whereby the benefits of said treatments are substantially realised during flotation without an unacceptable loss of grade and recovery.

2. A process as defined in claim 1 wherein the fine stream and/or the coarse stream are treated in a cleaning circuit of the flotation process.

3. A process as defined in claim 2 wherein the fine stream and the coarse stream are treated in the cleaning circuit with moderate amounts of acid/activator and alkali/depressant, respectively.

4. A process as defined in claim 1 wherein the cut size is in the range 25 to 45 micron.

5. A process as defined in claim 1 wherein the coarse and fine streams are separated using cyclones.

6. A process as defined in claim 5 wherein a plurality of cyclones are arranged in series for separating the pulp into the coarse and fine streams.

7. A process as defined in claim 1 wherein the coarse and fine streams are separated before a rougher-scavenger stage of the flotation process.

8. A process as defined in claim 1 wherein the fine stream is floated at a low solid/liquid ratio to avoid the tendency for pulps to become viscous and to lower the recovery of fine magnesium minerals into the froth by physical carry-over with the water, the so-called entrainment effect.

9. A process as defined in claim 1 wherein the acid and/or activator is added to the fine stream during one or more of the following stages:

fine stream cleaner feed conditioning;

fine stream cleaner bank;

fine stream recleaner bank;

fine stream cleaner-scavenger bank; and/or fine stream third cleaner bank.

10. A process as defined in claim 1 wherein the fine stream is treated with an acid selected from the group consisting of sulphuric acid, hydrochloric acid, nitric acid, sulphurous acid, suiphamic acid, or some other suitable inorganic/organic acid.

11. A process as defined in claim 1 wherein the fine stream is treated with an activator selected from the group consisting of copper sulphate, lead nitrate, sodium sulphide, sodium hydrogen sulphide, sodium hydrosulphide or some other inorganic or organic reagent.

12. A process as defined in claim 1 wherein the alkali and/or depressant is added to the coarse stream during one or more of the following stages:

coarse stream cleaner feed conditioning; and/or coarse stream cleaner bank.

13. A process as defined in claim 1 wherein the coarse stream is treated with an alkali selected from the group consisting of sodium hydroxide, sodium carbonate or ammonia, or some other suitable inorganic/organic base.

14. A process as defined in claim 1 wherein the coarse stream is treated with a depressant selected from the group consisting of guar or starch or some other inorganic or organic reagent.

15. An apparatus for flotation of sulphide minerals, the apparatus comprising:

means for separating a flotation pulp containing the sulphide minerals into a coarse stream and a fine stream at a cut size in the range of 20 to 50 microns;

an acid and activator source for treating the fine stream with acid and/or activator;

an alkali and depressant source for treating the coarse stream with alkali and/or depressant whereby the benefits of said treatments can be substantially realised during flotation without an unacceptable loss of grade and recovery; and means for providing at least two separate flotation stages, one for flotation treatment of the fine stream and another for flotation treatment of the coarse stream.

16. An apparatus as defined in claim 15 wherein the acid and activator source comprises one or more of a fine stream conditioning tank, a fine stream cleaner bank, a fine stream cleaner-scavenger bank, a fine stream recleaner bank and/or fine stream third cleaner bank to which the acid and/or activator are added to one or more of the apparatus.

17. An apparatus as defined in claim 15 wherein the acid and/or the activator is added to a conditioning tank, a pipe/chute and/or a flotation cell.

18. An apparatus as defined in claim 15 wherein the alkali and depressant source comprises one or more of a coarse stream conditioning tank and a coarse stream cleaner bank to which the alkali and/or depressant are added to one or more of the apparatus.

19. An apparatus as defined in claim 15 wherein the alkali and/or the depressant is added to a conditioning tank, a pipe/chute and/or a flotation cell.

20. An apparatus as defined in claim 15 wherein the means for separating the pulp into a coarse stream and a fine stream comprises clusters of cyclones.

21. An apparatus as defined in claim 15 wherein said separating means is a single cyclone.

* * * * *

UNITED STATES PATENT AND TRADEMARK OFFICE

CERTIFICATE OF CORRECTION

PATENT NO. : 7,028,845 B2
APPLICATION NO. : 10/469247
DATED : April 18, 2006
INVENTOR(S) : Senior, Geoffrey David It is certified that error appears in the above-identified patent and that said Letters Patent is hereby corrected as shown below:

Column 10, Line 52, please delete “suiphamic” and replace with --sulphamic--.

Signed and Sealed this

First Day of August, 2006

JON W. DUDAS
*Director of the United States Patent and Trademark Office*